US007108354B2

(12) United States Patent
Gulvin et al.

(10) Patent No.: US 7,108,354 B2
(45) Date of Patent: Sep. 19, 2006

(54) ELECTROSTATIC ACTUATOR WITH SEGMENTED ELECTRODE

(75) Inventors: Peter M. Gulvin, Webster, NY (US); Joel A. Kubby, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 231 days.

(21) Appl. No.: 10/873,125

(22) Filed: Jun. 23, 2004

(65) Prior Publication Data

US 2005/0285902 A1 Dec. 29, 2005

(51) Int. Cl.
*B41J 2/06* (2006.01)
*B41J 29/38* (2006.01)
*B41J 2/04* (2006.01)

(52) U.S. Cl. ..... 347/55; 347/10; 347/54

(58) Field of Classification Search ..... 347/9, 347/11, 54, 55, 57, 58, 59, 68, 70
See application file for complete search history.

(56) References Cited

U.S. PATENT DOCUMENTS

| | | | | |
|---|---|---|---|---|
| 5,534,900 | A | 7/1996 | Ohno et al. | 347/54 |
| 5,821,951 | A * | 10/1998 | Fujii et al. | 347/10 |
| 6,312,108 | B1 | 11/2001 | Kato | 347/54 |
| 6,357,865 | B1 | 3/2002 | Kubby et al. | 347/68 |
| 6,367,915 | B1 | 4/2002 | Gooray et al. | 347/54 |
| 6,409,311 | B1 | 6/2002 | Gooray et al. | 347/54 |
| 6,572,218 | B1 | 6/2003 | Gulvin et al. | 347/54 |
| 6,702,209 | B1 | 3/2004 | Furlani et al. | 239/690 |
| 6,863,382 | B1 * | 3/2005 | Anagnostopoulos et al. | 347/70 |
| 2002/0096488 | A1 | 7/2002 | Gulvin et al. | 216/27 |
| 2002/0097303 | A1 | 7/2002 | Gulvin et al. | 347/65 |
| 2003/0087468 | A1 | 5/2003 | Gulvin et al. | 438/50 |

* cited by examiner

*Primary Examiner*—Lamson Nguyen
*Assistant Examiner*—Lisa M Solomon
(74) *Attorney, Agent, or Firm*—Oliff & Berridge, PLC.

(57) ABSTRACT

An electrostatic actuator includes a segmented flexible membrane associated with individually addressable electrodes, one for each membrane segment. The electrodes are provided beneath a corresponding one of the membrane segments to define a plurality of actuator chambers between each of the electrodes and the corresponding membrane segment. Control electronics independently provide a bias voltage to select ones or all of the electrodes to generate an electrostatic field between any bias electrode and the corresponding membrane segment to attract the corresponding membrane segment toward the respective electrode. Upon elimination of the bias voltage, the corresponding membrane segments are elastically restored to their previous position. This structure can be incorporated into a fluid drop ejector to achieve variable drop size by control of the number of segments actuated. Additionally, by control of the time and space domain of the segment firing, the pressure pulse created by the fluid drop ejector can be precisely controlled.

27 Claims, 9 Drawing Sheets

ELECTROSTATIC ACTUATOR WITH SEGMENTED ELECTRODE

BACKGROUND OF THE INVENTION

1. Field of Invention

The invention relates to an electrostatic actuator, preferably a micromachined or micro-electromechanical system (MEMS) based fluid drop ejector, having a segmented membrane with an independently addressable electrode for each segment.

2. Description of Related Art

Fluid ejectors have been developed for inkjet recording or printing, as well as other uses. Ink jet recording apparatus offer numerous benefits, including extremely quiet operation when recording, high speed printing, a high degree of freedom in ink selection, and the ability to use low-cost plain paper. The so-called "drop-on-demand" drive method, where ink is output only when required for recording, is now the conventional approach. The drop-on-demand drive method makes it unnecessary to recover ink not needed for recording.

Fluid ejectors for inkjet printing include one or more nozzles which allow the formation and control of small ink droplets to permit high resolution, resulting in the ability to print sharper characters with improved tonal resolution. In particular, drop-on-demand inkjet print heads are generally used for high resolution printers.

Drop-on-demand technology generally uses some type of pulse generator to form and eject drops. In one type of print head, a chamber having an ink nozzle may be fitted with a piezoelectric wall that is deformed when a voltage is applied. As a result of the deformation, the fluid is forced out of the nozzle orifice as a drop. The drop then impinges directly on an associated printing surface.

Another type of print head uses bubbles formed by heat pulses to force fluid out of the nozzle. The drops are separated from the ink supply when the bubbles form.

Yet another type of drop-on-demand print head incorporates an electrostatic actuator. This type of print head uses electrostatic force to eject the ink. Examples of such electrostatic print heads are disclosed in U.S. Pat. No. 5,534,900 to Ohno et al., U.S. Pat. No. 6,312,108 to Kato, U.S. Pat. No. 6,367,915 to Gooray et al., U.S. Pat. No. 6,409,311 to Gooray et al., U.S. Pat. No. 6,702,209 to Furlani et al., U.S. Pat. No. 6,572,218 to Gulvin et al., U.S. Pat. No. 6,357,865 to Kubby et al., U.S. Patent Application Publication No. US. 2002/0096488A1 to Gulvin et al., U.S. Patent Application Publication No. US. 2002/0097303A1 to Gulvin et al., and US. 2003/0087468A1 to Gulvin et al., the disclosures of which are hereby incorporated by reference herein in their entireties.

When ejecting fluid, such as ink, one typical requirement is the ability to modulate the drop size. For ink jet printing, this is used to change the amount of color that is provided at various points in a print output. This can also be done by altering the number of drops that land in a certain area, but that requires a much higher firing rate to achieve either a similar or a same print speed.

For mechanical drop ejectors, such as electrostatic and piezoelectric drop ejectors, the size of the drop is usually determined partially by the amount of displacement. For electrostatic drop elector membranes in particular, the membranes are partially pulled down and the difference in displaced volume of fluid leads to different size drops being ejected.

However, when voltage causes the membrane to be pulled down approximately ⅓ of the total distance between the electrodes, the exponentially increasing parallel-plate capacitive force becomes larger than the linearly-increasing elastic restoring force of the membrane. This gives rise to a well-known "pull-in" instability in which the membrane is snapped the remainder of the distance between it and the underlying electrode. Because of this, there is a gap in the range of useable displacements (e.g., effectively everything from ⅔ volume to full volume displacement becomes unusable). Thus, there is a gap in the size of drops that can be created.

The governing equation is derived below as equation (1), taking the derivative of the energy in the capacitor with respect to displacement to arrive at the force. The result is a function of both V and x, which is why the force increases so dramatically as the displacement increases.

$$F_x=-\partial U/\partial x=-\partial/\partial x(\tfrac{1}{2}CV^2)=-\partial/\partial x(\tfrac{1}{2})\ (\epsilon_o A/x)V^2=(\epsilon_0 A/2)(V/x)^2 \quad (1)$$

FIGS. 1–3 show a conventional MEMS-based electrostatically actuated diaphragm, in which a membrane is controlled by an electrode. FIG. 1 is a cross-sectional view of electrostatically actuated diaphragm 10 in a relaxed state. Substrate 20 is typically a silicon wafer. Insulator layer 30 is typically a thin film of silicon nitride, $Si_3N_4$. Conductor 40 acts as a counterelectrode and is typically either a metal or a doped semiconductor film such as polysilicon. Membrane 50 is made from a structural material such as polysilicon, as is typically used in a surface micromachining process. Nipple 52 is attached to a part of membrane 50 and acts to separate the membrane from the conductor when the membrane is pulled down towards the conductor under electrostatic attraction when a voltage or current, as indicated by power source P, is applied between the membrane and the conductor. Actuator chamber 54 between membrane 50 and substrate 20 can be formed using typical techniques, such as by surface micromachining.

FIG. 2 is a cross-sectional view of electrostatically actuated diaphragm 10, which has been displaced from its relaxed position by an application of a voltage or current between membrane 50 and conductor 40. The motion of membrane 50 then reduces the actuator chamber volume. Actuator chamber 54 can either be sealed at some pressure, or open to atmosphere to allow the air in the actuator chamber to escape (hole not shown). For gray scale printing, the membrane can be pulled down to an intermediate position using a charge driving mode. The volume reduction in the actuator chamber will later determine the volume of fluid displaced when a nozzle plate has been added as discussed below.

FIG. 3 shows a cross-sectional view of electrostatically actuated diaphragm 10, which has been pulled-down towards conductor 40. Nipple 52 on membrane 50 lands on insulating film 30 and acts to keep the membrane from contacting the conductor. This represents the maximum amount of volume reduction possible in the actuator chamber.

FIG. 4–6 show a conventional fluid ejector incorporating the diaphragm of FIGS. 1–3. FIG. 4 is a cross-sectional view of an electrostatically actuated fluid ejector 100. Nozzle plate 60 is located above electrostatically actuated membrane 50, forming a fluid pressure chamber 64 between the nozzle plate and the membrane. Nozzle plate 60 has nozzle 62 formed therein. Fluid 70 is fed into this chamber from a fluid reservoir (not shown). The fluid pressure chamber can be separated from the fluid reservoir by a check valve to restrict fluid flow from the fluid reservoir to the fluid pressure chamber. The membrane is initially pulled-down by an applied voltage or current. Fluid fills in the volume created by the membrane deflection.

FIG. 5 shows a cross-sectional view of the electrostatically actuated fluid ejector when the bias voltage or charge is eliminated. As the bias voltage or charge is eliminated, the membrane relaxes, increasing the pressure in the fluid pressure chamber. As the pressure increases, fluid 72 is forced out of the nozzle formed in the nozzle plate.

FIG. 6 is a cross-sectional view of the electrostatically actuated fluid ejector with the membrane back to its relaxed position. In the relaxed position, the membrane 50 has expelled a fluid drop 72 from pressure chamber 64. When the fluid ejector is used for marking, fluid drop 72 is directed towards a receiving medium (not shown).

The drop ejector uses deformable membrane 50 as an actuator. The membrane is typically formed using standard polysilicon surface micromachining, where the polysilicon structure that is to be released is deposited on a sacrificial layer that is finally removed. Electrostatic forces between deformable membrane 50 and conductor 40 deform the membrane. For constant volume or constant drop size fluid ejection, the membrane is actuated using a voltage drive mode, in which a constant bias voltage is applied between the parallel plate conductors that form the membrane and the conductor.

To avoid this "pull-in" instability, one could control the charge present instead of the voltage. Equation (2) below also differentiates the energy in the capacitor with respect to displacement, but it starts with the energy in terms of charge instead of voltage. As can be seen, the resulting force depends on charge, but not displacement. This solution balances capacitor force with membrane restoring force for all values of displacement, including those that are inaccessible using the above voltage drive mode. Examples of a fluid ejector driven in the charge mode can be founding U.S. Pat. No. 6,357,865 to Kubby et al. and U.S. Pat. No. 6,572,218 to Gulvin et al. Thus, for variable volume or drop size fluid ejection, the fluid ejector 100 relies on a charge drive mode, wherein the charge between the parallel plate conductors is controlled.

$$F_x=-\partial U/\partial x=-\partial/\partial x(\tfrac{1}{2})(Q^2/C),=-\partial/\partial x(\tfrac{1}{2})\ (x/\epsilon_0 A)$$
$$Q^2=Q^2/2\epsilon_0 A) \quad (2)$$

Unfortunately, however, voltage drive mode is much easier to implement than charge drive mode, which requires a very complex circuit. One such circuit is a "switched capacitor" circuit, such as circuit 200 shown in FIG. 7 where a supply capacitor acts as the intermediary between the voltage source V and the load capacitor (e.g., the device or fluid ejector) so that they are never directly connected as would be in voltage control.

This device (fluid ejector) is used as the output capacitor of an op amp circuit in an integrator configuration. The supply capacitor is charged or discharged from voltage source V, then switched so that it connects to the load capacitor (e.g., the fluid ejector device), charging or discharging it. Charge is transferred to or from the load capacitor, and then the supply capacitor is switched back to the voltage source. This proceeds in cycles, which, if run quickly enough, start to resemble an analog waveform. However, because of this circuit complexity, voltage drive mode is much more prevalent than charge drive mode. Accordingly, conventional fluid ejectors have problems with generating variable drop size and suffer "pull-in" problems, unless complex charge drive mode electronics are implemented.

SUMMARY OF THE INVENTION

The systems and methods of this invention provide an electrostatic actuator with multiple semi- or totally-independent membrane segments, each with its own electrode for actuation.

In exemplary embodiments of the methods and systems of the invention, the actuator forms an electrostatic fluid drop ejector.

Exemplary embodiments of the systems and methods of this invention separately provide an electrostatic fluid ejector that can attain variable drop size using voltage control. This can be achieved, for example, by varying the number of membrane segments that are pulled down, either partially or fully.

The systems and methods of this invention separately provide the ability to customize the waveform created by the membrane. For example, this can be achieved by controlling the timing and selection of electrodes being actuated. This independent firing of segments separated in either time or space can be used to shape the resulting pressure pulse generated by the diaphragm.

The systems and methods of this invention separately provide for a mechanism to reduce adjacent membrane segment interaction. This may be achieved, for example, through variation in membrane thickness in certain areas to reduce membrane interaction. It also can be achieved by mechanical isolation of sections through full or partial anchoring of membrane section components.

The systems and methods of this invention separately provide a landing post to prevent shorting and stiction.

The systems and methods of this invention separately provide a segmented fluid ejector integrated with on-chip addressing electronics to reduce package complexity.

The systems and methods of this invention separately provide a segmented fluid drop ejector with a closed-loop control system. This control system can, for example, prevent shorting and stiction.

According to various exemplary embodiments of the systems and methods of this invention, an electrostatic actuator includes a base substrate and a segmented flexible membrane provided on top of the substrate. Individually addressable electrodes, one for each membrane segment, are provided beneath a corresponding one of the membrane segments. A plurality of actuator chambers are defined between each of the electrodes and the corresponding membrane segment. The individually addressable electrodes are selectively actuated to receive a bias voltage that generates an electrostatic field between any biased electrode and the corresponding membrane segment to attract the corresponding membrane segment toward the respective electrode, the corresponding membrane segment being elastically restored to its previous position upon elimination of the bias voltage.

According to various exemplary embodiments of the systems and methods of this invention, the segmented actuator forms part of a fluid drop ejector that individually addresses any or all of the membrane segments to control the droplet volume.

In exemplary embodiments, the fluid drop ejector includes a nozzle plate surrounding the membrane, the nozzle plate defining a fluid pressure chamber between the nozzle plate and the membrane where fluid is stored. The nozzle plate has a nozzle from which fluid is ejected.

According to various exemplary embodiments of the systems and methods of this invention, the segmented actuator can alter the electrode firings in the time and/or space domain to closely control the resultant pressure pulse generated by the actuator. When used as a fluid drop ejector, this can assist in droplet formation.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the methods and devices of this invention are described in detail below, with reference to the attached drawing figures, in which.

DETAILED DESCRIPTION OF PREFERRED EMBODIMENTS

Exemplary embodiments of systems and method according to the invention will be described with reference to an exemplary electrostatically actuated diaphragm, particularly suited as a fluid drop ejector for printing inks. However, the invention is not limited to this. Fluid drop ejectors may be used not only for printing, but also for depositing photoresist and other liquids in the semiconductor and flat panel display industries, for delivering drug and biological samples, for delivering multiple chemicals for chemical reactions, for handling DNA sequences, for delivering drugs and biological materials for interaction studies and assaying, and for depositing thin and narrow layers of plastics for use as permanent and/or removable gaskets in micro-machines. Additionally, the electrostatic actuator may act as a fluid pump, or as a mechanical actuator that moves an object, such as a solid or gaseous object.

Figure 1:
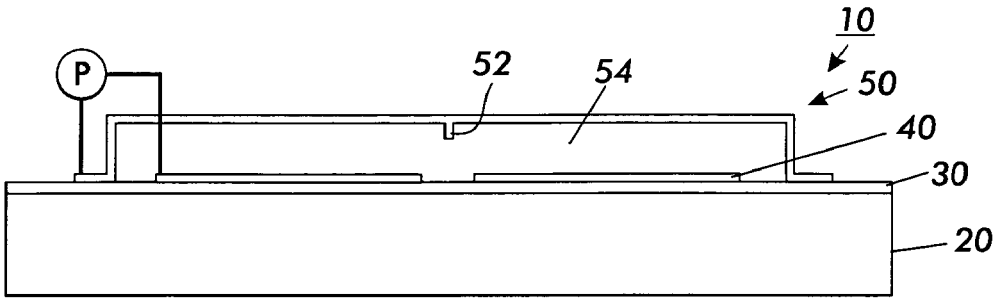
FIG. 1 RELATED ART
FIG. 1 is a cross-sectional view of a conventional electrostatically actuated diaphragm in a relaxed state.
Figure 2:
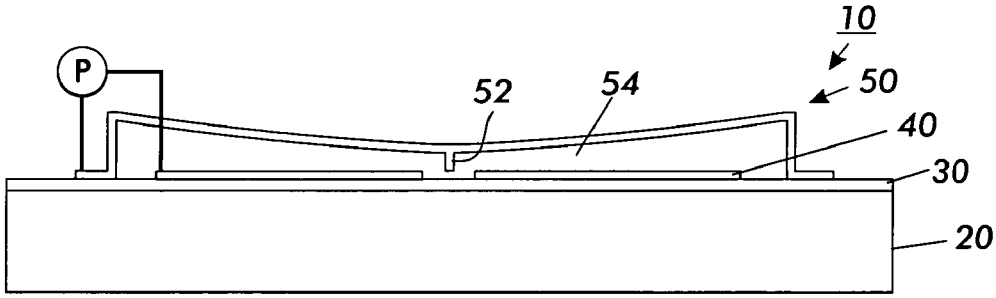
FIG. 2 RELATED ART
FIG. 2 is a cross-sectional view of a conventional electrostatically actuated diaphragm in an intermediate state.
Figure 3:
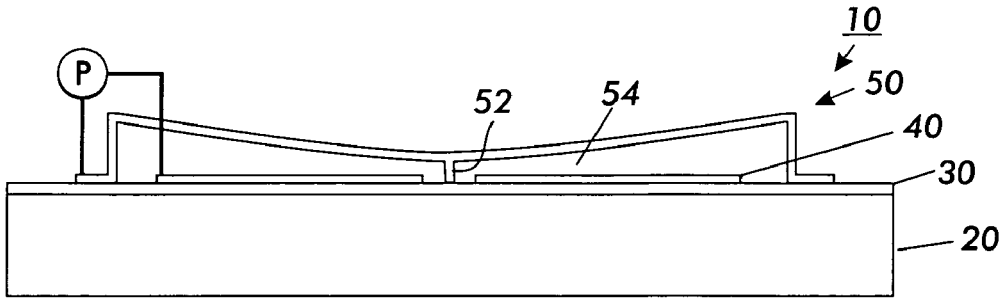
FIG. 3 RELATED ART
FIG. 3 is a cross-sectional view of a conventional electrostatically actuated diaphragm in a maximum displaced state.
Figure 4:
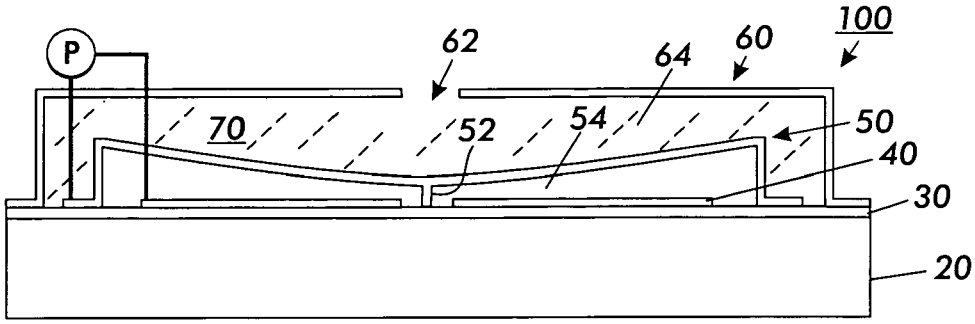
FIG. 4 RELATED ART
FIG. 4 is a cross-sectional view of a conventional electrostatically actuated fluid ejector in a maximum displaced state.
Figure 5:
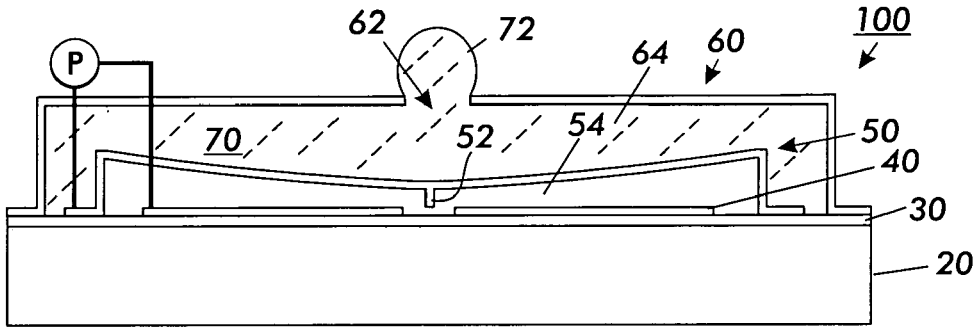
FIG. 5 RELATED ART
FIG. 5 is a cross-sectional view of a conventional electrostatically actuated fluid ejector in an intermediate state.
Figure 6:
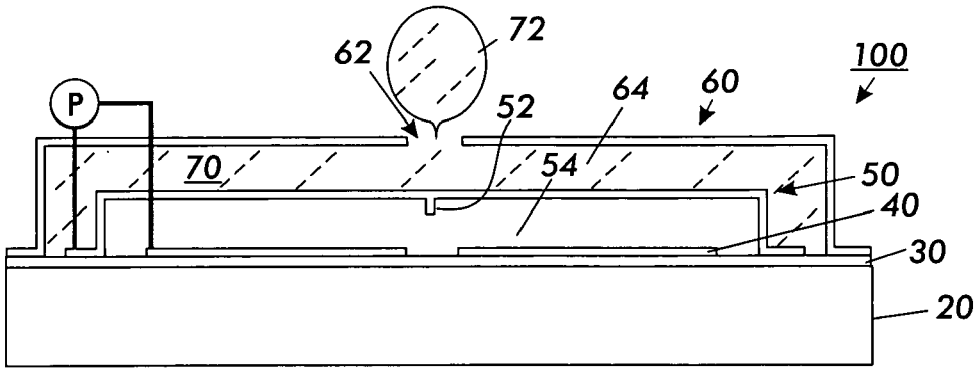
FIG. 6 RELATED ART
FIG. 6 is a cross-sectional view of a conventional electrostatically actuated fluid ejector in a relaxed state.
Figure 7:
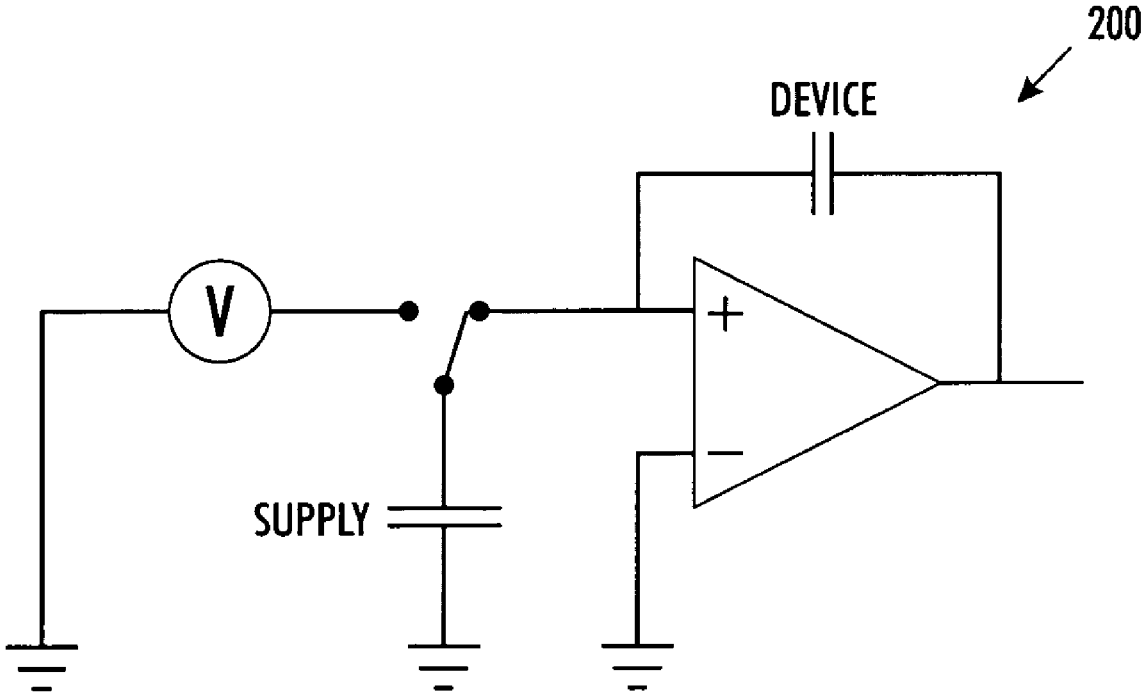
FIG. 7 RELATED ART
FIG. 7 is an exemplary circuit showing a conventional charge drive mode of a fluid ejector.
Figure 8:
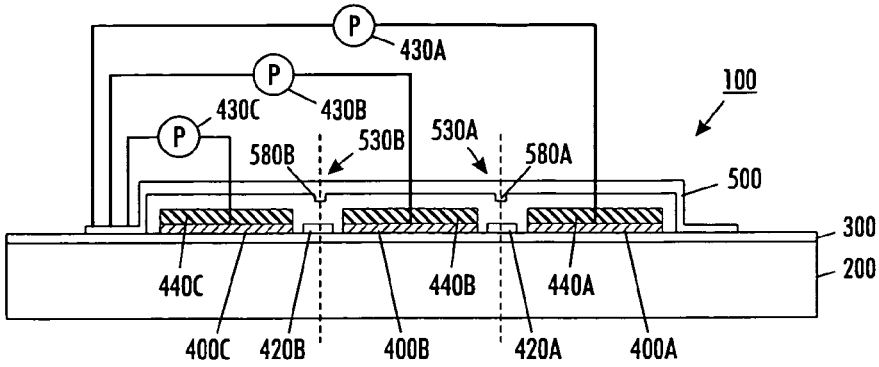
FIG. 8 is a cross-sectional view of an electrostatically actuated diaphragm useful as a fluid ejector according to an embodiment of the invention shown in a relaxed state and having multiple membrane segments, each having at least one independently addressable electrode.
Figure 9:
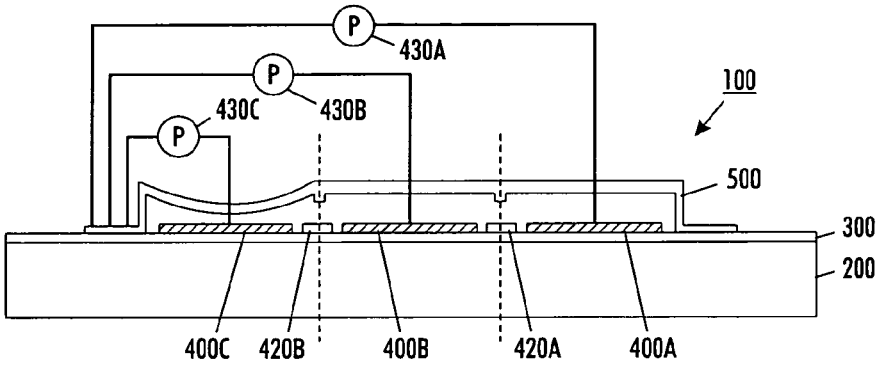
FIG. 9 is a cross-sectional view of the electrostatically actuated diaphragm of FIG. 8 shown in a first exemplary partially displaced state.
Figure 10:
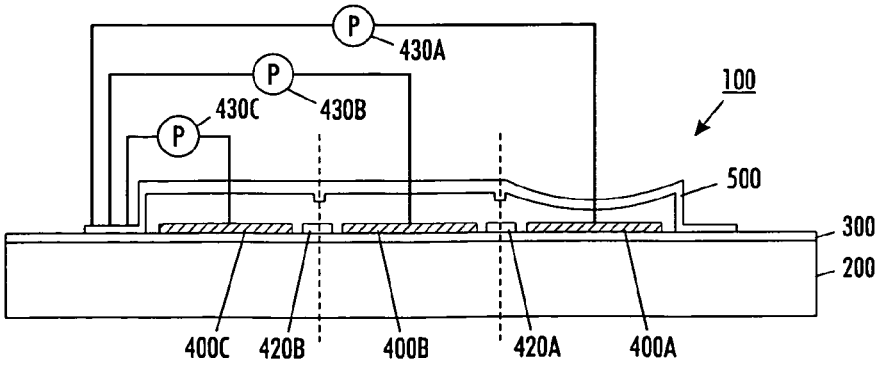
FIG. 10 is a cross-sectional view of the electrostatically actuated diaphragm of FIG. 8 shown in a second, different exemplary partially displaced state.

A first embodiment of an improved segmented electrostatic actuator that overcomes problems of single electrode diaphragms or membranes will be described with reference to FIGS. 8–10.

As in prior conventional diaphragms having a single electrode, an exemplary inventive electrostatically actuated diaphragm 100 can include a substrate 200, typically a silicon wafer, and an insulator layer 300, such as $Si_3N_4$. However, rather than having a single membrane actuated by a single corresponding addressable electrode, the invention provides a segmented membrane 500 having independently actuatable conductor electrodes or electrode segments 400A–C, one for each segment of the membrane 500. Segmented membrane 500 can be formed from polysilicon and the electrodes can be formed from metal or doped polysilicon.

In various exemplary embodiments of the systems and methods of the invention, variable drop size is achieved by changing the number of segments of the membrane that are "pulled down" by electrostatic attraction to addressed electrode segments. For example, the membrane segments can be completely pulled down, so that the full volume is realized, as opposed to only being able to pull the membrane ⅓ of the size of the gap.

The equation for determining displaced volume is:

$$V = \int_0^{w/2} \frac{d}{2}\left(1 + \cos\left(\frac{2\pi x}{w}\right)\right) L dx = \frac{dLw}{2} \tag{3}$$

where d is the displacement of the center of the membrane, w is the width of the membrane, and L is the length of the membrane. Therefore, by being able to use a full pull down results in a 3× increase in the displaced volume of fluid compared to prior methods with "pull-in" instability.

This 3× increase in displacement causes the membrane restoring force to also increase three-fold. This increases the magnitude of the resultant pressure pulse, which can have numerous advantages. It may allow inks with larger viscosity to be ejected. Alternatively, the surplus of pressure could allow the membrane to be made thinner and more flexible, therefore allowing operation at lower voltages. Moreover, higher pressures will often lead to higher drop velocity, which in an inkjet device will usually lead to better directionality, and thus better print quality.

An additional benefit of full pull-down is reproducibility. Because the drop volume will no longer depend on the applied voltage, but only on the thickness of the gap between membrane and electrode, drop volume can be well controlled and will not vary with time.

This ability to provide variable drop size is achieved by having each electrode 400A–C independently driven by a power source 430A–C so as to cause each corresponding membrane segment to be pulled down under electrostatic attraction when a bias voltage or current is applied. The segmented membrane 500 and individually addressable electrodes 400A–C define a plurality of semi-independently controlled actuator chambers 540A–C therebetween. The actuator chambers can be formed using surface micromachining or other conventional techniques.

When a voltage higher than the pull-down voltage is applied to one of the segments of the electrode (i.e., any of electrodes 400A–C), the membrane segment above the electrode is pulled down and then snapped into contact with the bottom electrode. To prevent shorting, an insulating layer or a layer of high resistance 440 A, B, C such as silicon nitride can be provided between the membrane and electrode. High resistance may be preferable to a true insulator because charging problems can occur if there is no mechanism for the charge to dissipate.

Alternatively, as shown, one or more landing posts 580A, B can be provided, which hit an isolated region 420A, B in area 530A, B where contact is likely to occur, to prevent the opposing voltages from coming into contact. Landing posts 580A, B also avoid problems with stiction, which is a common failure mode in MEMS where two surfaces that come into contact become permanently attached by Van der Waals forces. Because the landing post minimizes the amount of surface area that can come into contact, stiction force is decreased.

The segments of the membrane 500 may not necessarily be totally independent from each other, even though the electrode activation is. This is due to the flexibility of the membrane. A segment fully pulled down may slightly lower the very edge of a neighboring segment. For example, see FIGS. 9–10 where only a leftmost segment is actuated (FIG. 9) or a rightmost segment actuated (FIG. 10). In both, there is a slight lowering of the adjacent edge. This will result in a slight difference in displaced volume for the various segments. However, this can be readily compensated either empirically, or through testing and calibration procedures. Also, in a long, single row array as shown, the end segments are more fully supported than the segment(s) in the middle. This is because they are anchored on both sides and an end, whereas middle segments are only anchored on the sides. If such differences are objectionable, they can be minimized, for example, by changing the widths of the sections to accommodate differences in displaced volume. Alternatively, the various segments can be kept mechanically separated by partial anchoring of the membrane at the boundary between sections, allowing air to pass freely, but supporting the membrane.

The shape of the diaphragm would depend on the application. In the exemplary embodiments shown, there are three linearly arranged segments. In an application when the linear density of devices needs to be high, such as in an ink jet system when the number of devices per inch decides the highest printing resolution, a long and narrow shape, is preferable. As the device is made narrower, the membrane has a higher stiffness and displaces less fluid. This can be counteracted, however, by making the device longer to increase the displacement, and using a thinner layer for the membrane, decreasing the stiffness. Obviously, the number of segments can be appropriately adjusted for a particular application. This may take the form of a single dimensional array, but could also be a two dimensional array (M×N) in which one direction is longer than the other.

Arrays, either aligned or staggered, are another possible configuration useable to give a high linear density when the geometry of the device does not allow tighter packing. The best shape may be a square. The segments could then be defined as a N×N array. However, the array need not be square, but can be rectangular or otherwise. "Crosstalk" between segments would be higher than in a long rectangle configuration, since pull-down of one segment may effect multiple neighboring segments. This may lead to a slightly higher drop size. However, this could be compensated for by changing the size of the square, for example.

With this segmented design, it is possible to reliably control and achieve variable droplet size by controlling how many individual segments are fully pulled down. For example, in the three segment actuator shown in FIGS. 8–10, it is possible to actuate any combination of the three segments to achieve anywhere from ⅓ up to full volume displacement by fully pulling down individual segments. Besides an application where each individual segment is fully pulled down to achieve an adjustable volume for the overall membrane, the invention can also be used with partial pull-down of each segment. However, this would lose the advantage of larger volume displacement. If an inexpensive way of implementing charge control is devised, then it could regain that advantage.

The shape of the segmented membrane may also be useful in shaping the resultant pressure/wave of the liquid being dropped. That is, if the actuator will form a drop ejector used in a scheme where it is responsible for the shaping of the pulse or wave of the ejected fluid, the shape can be manipulated to give a proper result. For example, besides the ability to achieve varying drop size, a segmented electrode design also has the flexibility to vary the times at which various segments are fired, allowing the generated pressure pulse to be shaped in time and/or position. Moreover, such pressure pulse manipulation can be used to avoid formation of "satellite" droplet formation (unintended extra droplets that exit the nozzle), or to avoid air ingestion into the fluid chamber.

Figure 11:
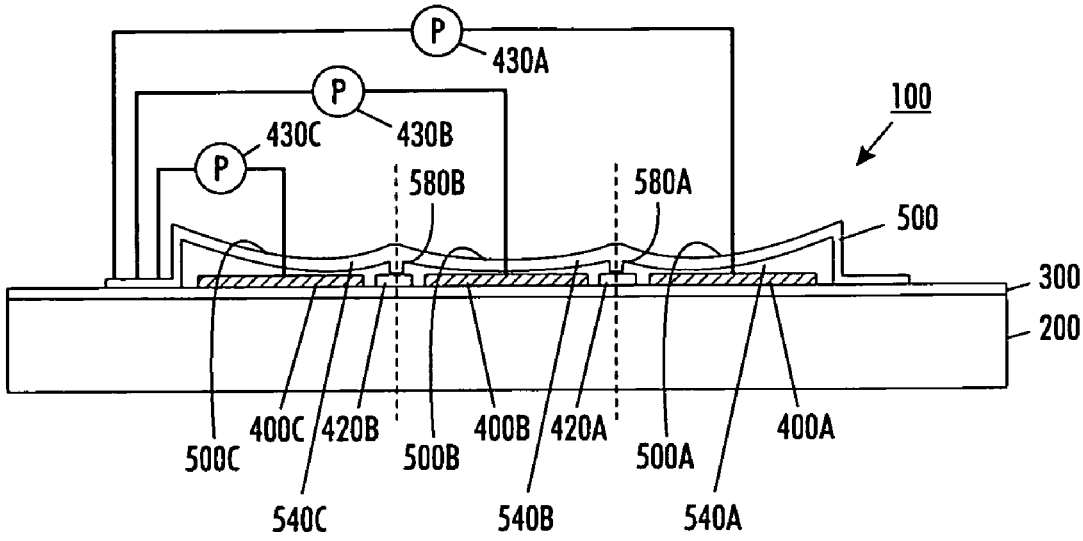
FIG. 11 is a cross-sectional view of an electrostatically actuated diaphragm useful as a fluid ejector according to another embodiment of the invention shown in a maximum displaced state and having multiple membrane segments, each having at least one independently addressable electrode.
Figure 12:
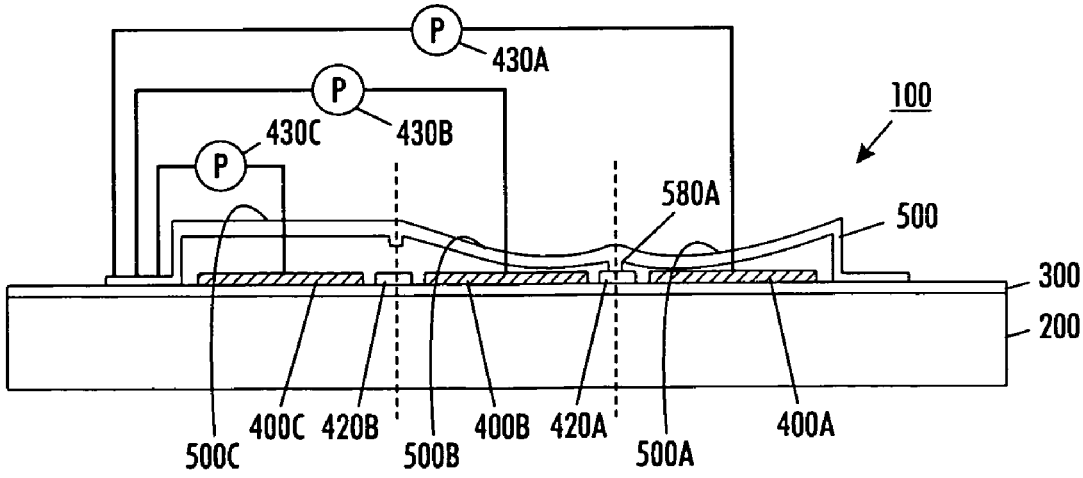
FIG. 12 is a cross-sectional view of the electrostatically actuated diaphragm of FIG. 11, after a first time period in which a first electrode has been released.
Figure 13:
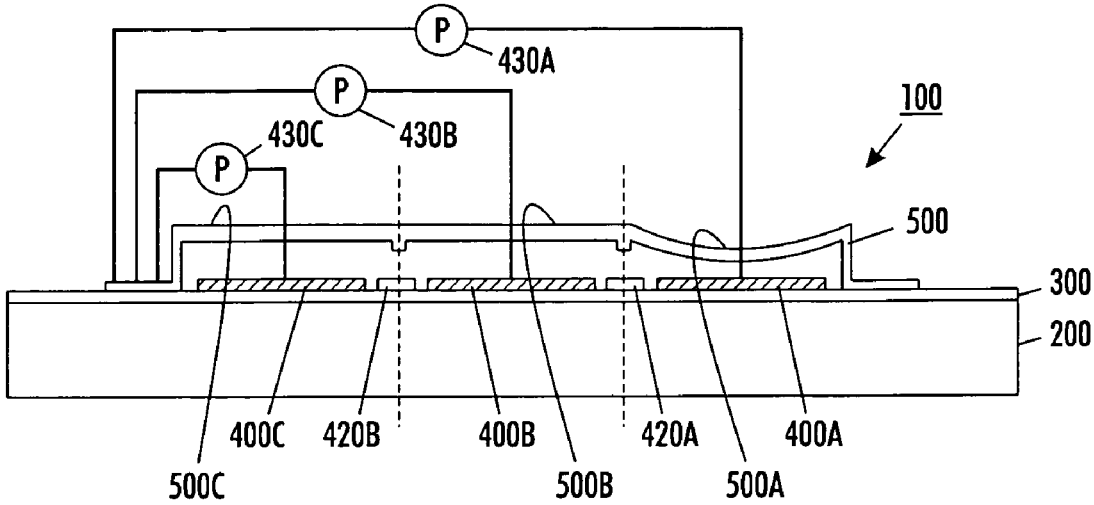
FIG. 13 is a cross-sectional view of the electrostatically actuated diaphragm of FIG. 11, after a second time period in which both the first and second electrode have been released.
Figure 14:
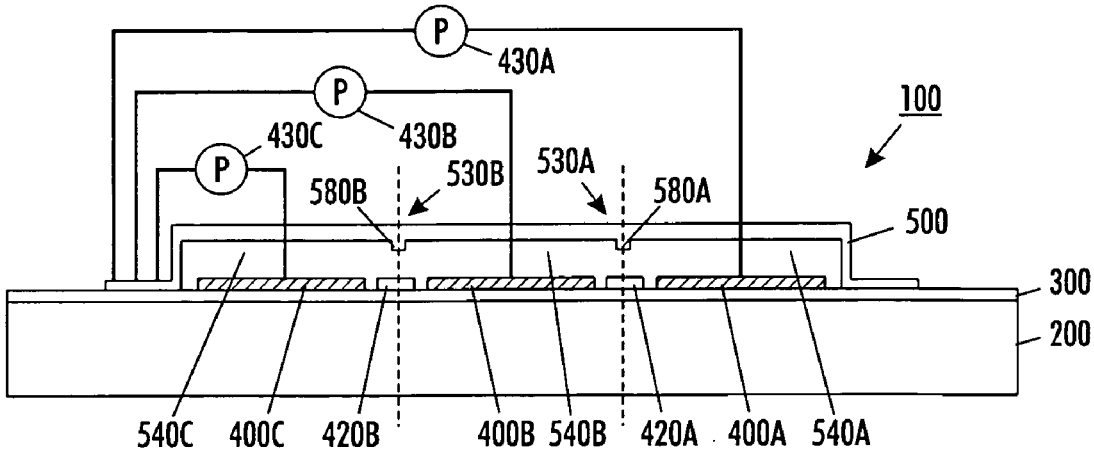
FIG. 14 is a cross-sectional view of the electrostatically actuated diaphragm of FIG. 11, after a third time period in which each of first, second and third electrodes have been released to form a controlled pressure waveform.

One embodiment of this would be to shape the ejector array so that the pressure waves will effect how the fluid is fed to a nozzle, for example. See FIGS. 11–14 where at a first timing (FIG. 11), all three segments are actuated to provide full displacement of fluid. Then, at a second timing (FIG. 12), electrode 400C is deactivated (bias voltage eliminated) so that chamber 540C is elastically restored. Then, at a third timing (FIG. 13), electrode 400B is deactivated so that now both chambers 540C and 540B have been restored. Then, at a fourth timing (FIG. 14), electrode 400A is deactivated so that now all chambers 540C, 540B and 540A have been restored. This sequential release creates a pressure wave or pulse that advances from left to right, in a ripple effect, which can control the movement of the fluid being ejected by the electrostatic actuator. That is, by controlling the time and space domain, the pressure pulse generated can be more precisely controlled.

The segmented actuator of this invention may be easily produced via monolithic batch fabrication based on the common production technique of silicon-based surface micro-machining and would have the potential for very low cost of production, high reliability and "on demand" drop size modulation. However, while the following discussion of the systems and methods of this invention may refer to aspects specific to silicon-based surface micromachining, in fact other materials and production techniques for the fluid ejector of this invention are possible. Also, the systems and methods of the invention may be utilized in any mechanical configuration of such an actuator as a fluid drop ejector (e.g., "roof shooter" or "edge shooter") and in any size array.

Figure 15:
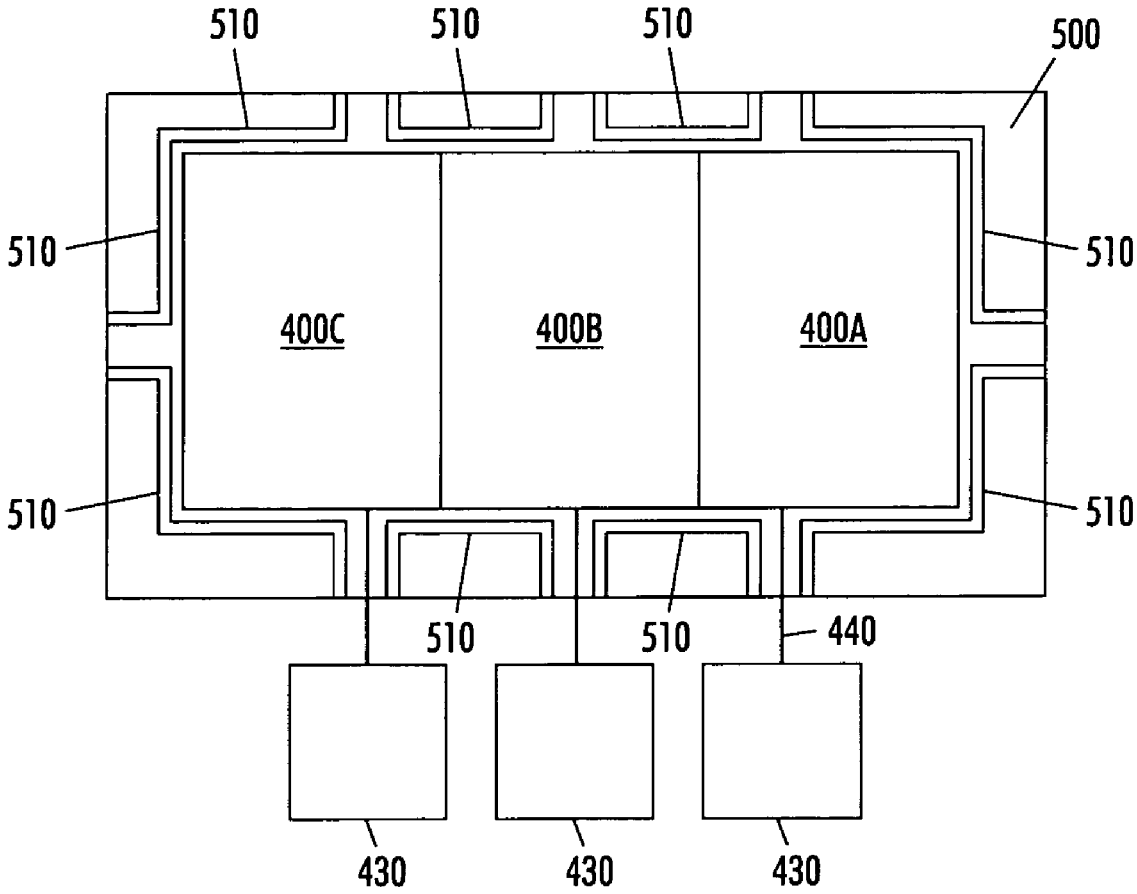
FIG. 15 is a top view of the electrostatically actuated diaphragm of FIGS. 11–14, showing the multiple membrane segments, each with an independently addressable electrode.

One method to create such a segmented actuator is shown in FIG. 15. This simple example is a 1×3 array. Bottom electrodes 400A–C can be formed by cutting an electrode into sections and running traces 440 to independent contact pads 430, which are independently connectable to a voltage source. Sidewalls 510 of the diaphragm serve as anchor points. Gaps can be included so that the sacrificial material, such as silicon dioxide, can be removed, for example, by front-side wet chemical etch, to create an air pocket. The gaps can be plugged later with an additional deposit of material to seal the device from the surrounding fluid that it is ejecting. Alternatively, through-wafer holes can be used with a back-side wet chemical release etch. The top layer is the flexible membrane 500, which forms the top electrode in a parallel-plate capacitor configuration with the electrode segments 400A–C below. The membrane 500 is preferably formed grounded so that it will not react electrically with the surrounding fluid. Additional manufacturing details can be found in the previously incorporated U.S. Pat. No. 6,572,218, U.S. Patent Application Publication No. US. 2002/0097303, US. Patent Application Publication No. US. 2003/0087468, and US. Patent Application Publication No. US. 2002/0096488.

Figure 16:
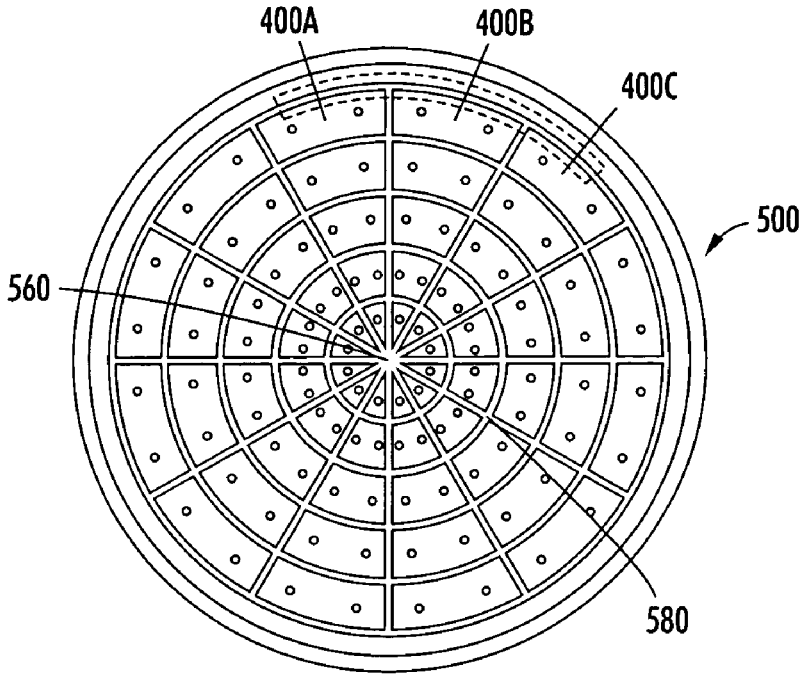
FIG. 16 is a top view of an alternative electrostatically actuatable diaphragm showing a circular membrane under which multiple individually addressable electrode segments are provided.

Another example of a suitable shape for the segmented membrane is a circular ejector with pie-shaped, toroidal, or concentric annular segments, as shown in FIG 16. This may be useful, for example, when the nozzle is very close to the membrane so that the symmetry has a very direct effect on the symmetry of the resultant drops ejected. With toroidal segments, it may be difficult to pull-down one segment without affecting neighboring sections. However, this would depend on the size of the device and the stiffness of the membrane, etc. Another way to reduce this effect will be described below.

In certain embodiments, the membrane may be flat, with a uniform layer of material. However, this does not have to be the case. One possible structure to reduce "crosstalk" between neighboring segments would be through use of a corrugated, multi-layer structure, such as that disclosed in U.S. Pat. No. 6,572,218, which has previously been incorporated by reference. Corrugating a layer of the membrane will increase the overall stiffness to decrease the interaction between segments. Alternatively, the same effect can be achieved through use of stiffening ribs 580 between adjacent segments as shown in FIG. 16. The stiffening ribs 580 meet at center 560.

Figure 17:
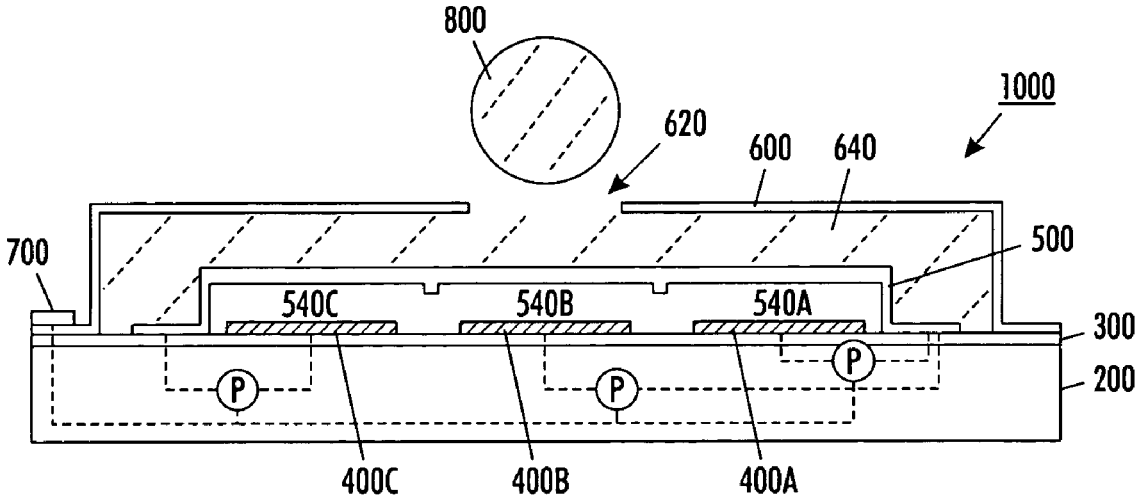
FIG. 17 is a cross-sectional view of an electrostatically actuated fluid ejector incorporating a segmented membrane with an independently addressable electrode for each segment.

An exemplary fluid ejector 1000 according to the systems and methods of this invention operates on the principle of electrostatic attraction and will be described with reference to FIG. 17. The basic features of the fluid ejector include a diaphragm arrangement, as described previously, in which the segmented electrode arrangement 400A–C is provided parallel and opposite to a segmented membrane 500. The fluid ejector further includes a faceplate 600. The faceplate may be formed, for example, from a polyimide layer. A liquid to be ejected is provided in fluid pressure chamber 640 provided between the membrane 500 and faceplate 600. The diaphragm formed by membrane 500 is situated opposite a nozzle hole 620 formed in the faceplate 600 of the ejector 1000. As in previous examples, the segmented membrane and electrode arrangement defines individually actuatable diaphragm chambers 540A–C. A drive signal, for example using either voltage or current control mode drive, from control electronics 700 is applied to at least one electrode segment (400A–C) to provide a bias voltage that generates an electrostatic field between the at least one electrode and a corresponding membrane segment. The corresponding membrane segment is attracted towards the at least one electrode by an electrostatic force of the generated electrostatic field into a deformed shape. This draws additional fluid into the fluid pressure chamber 640 to fill the volume previously occupied by the "pulled-down" membrane segment(s). Upon release of the bias voltage, elastic restoring forces of the flexible membrane act to return the actuated membrane segment to its original state. This transmits a pressure to the fluid pressure chamber 640, which acts to force fluid through the nozzle hole 620 as a drop 800 having a volume corresponding to the displaced volume of the actuated membrane segment. A one-way valve or comparable structure may be used to control entrance of fluid into pressure chamber 640 from a fluid reservoir, such as an ink tank, while preventing exit except through nozzle 620.

Each electrode/contact pad may be independently wire-bonded. This could lead to difficult packaging. In view of this, it may be desirable to integrate the fluid ejectors 1000 with on-chip circuitry, such as control electronics 700. With this, address electronics can be included that open and close switched connections at various segments through a voltage "bus." This is because in most cases the voltages applied to each segment do not need to be different. This results in the number of wire bonds only increasing logarithmically with an increasing number of segments, instead of linearly.

If the segments are not all fired simultaneously, a required delay can be hardwired into control electronics. Alternatively, desirable delay of firing may be decided by the control logic in real time at the time of firing.

With such capacitive-plate type diaphragm's, stiction and shorting can be problems. Although insulating or high resistance layers can be provided as discussed previously, it is also possible to reduce such problems through control electronics. By lowering the voltage after passing the snapping point where the individual membrane segments are provided sufficient force to be fully pulled-in, but before the pulled-in membrane segments touch their associated electrode, shorting can be reduced. However, this may affect any equilibrium achieved with voltage control in this region. It is possible to add a closed-loop feedback system that would sense the position of the membrane segments by its capacitance, and alter the voltage to maintain the unstable equilibrium. Such electronics would have to have a rapid response time, faster than the movement of the membrane segments.

Although the fluid drop ejector 1000 can operate using either voltage control or current control modes, voltage control is preferred, since it requires less complicated circuitry. However, because of the segmented electrode design, drop volume change can nonetheless be attained even using voltage control by control of the quantity of electrode segments addressed.

Figure 18:
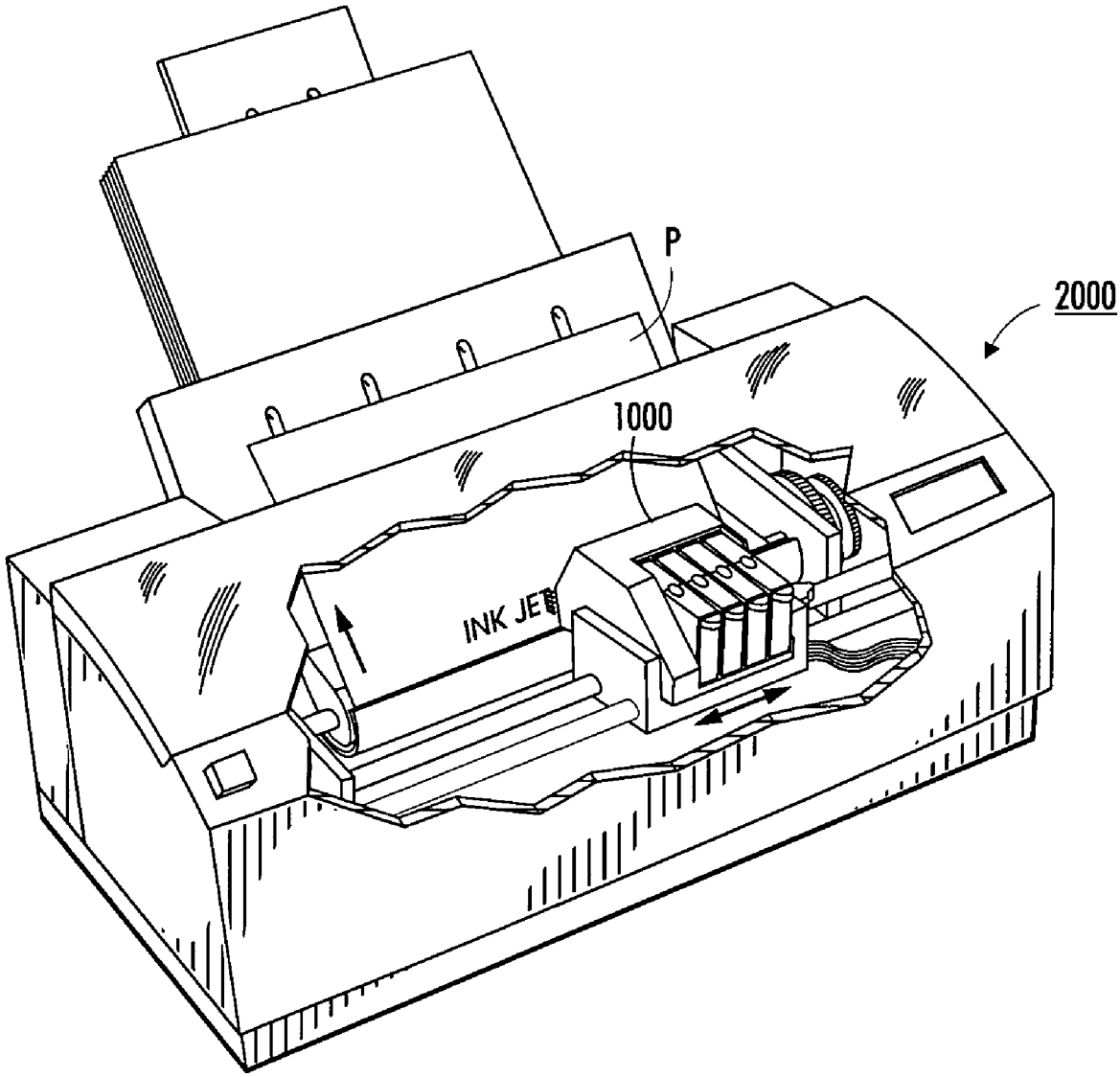
FIG. 18 shows an ink jet printer incorporating one or more fluid ejectors as a printhead according to the invention.

As shown in FIG. 18, one or more fluid drop ejectors 1000 can be incorporated into a printer 2000, such as an ink jet printer, to eject droplets of ink onto a substrate P. The individual fluid drop ejectors 1000 are operated in accordance with signals derived from an image source to create a desired printed image on print medium P. Printer 2000 may take the form of the illustrated reciprocating carriage printer that moves a printhead in a back and forth scanning motion, or of a fixed type in which the print substrate moves relative to the printhead.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention. For example, besides usefulness in ejecting or pumping fluids, the inventive segmented electrostatic actuator can serve as a mechanical device to manipulate objects, such as solids or gases. One exemplary non-limiting example of an application is in which the segmented actuator could include reflective or mirrored external surfaces. Actuation of various segments can manipulate the orientation of the various segments to alter the resultant optical property of the reflective surface. This can alter the optical property of light passing through or by the segmented actuator.

What is claimed is:

1. A segmented electrostatic actuator, comprising:

a base substrate;

a segmented flexible membrane provided on top of the substrate;

at least one strengthening rib incorporated into the flexible membrane and provided at segment boundaries:

individually addressable electrodes, one for each membrane segment, provided beneath a corresponding one of the membrane segments and separated from adjacent electrodes by an isolated region; and a plurality of actuator chambers defined between each of the electrodes and the corresponding membrane segment, wherein the individually addressable electrodes are selectively actuated to receive a bias voltage that generates an electrostatic field between any biased electrode and the corresponding membrane segment to attract the corresponding membrane segment toward the respective electrode, the corresponding membrane segment being restored to a previous position upon elimination of the bias voltage so that the at least one strengthening rib is separated by a predetermined distance from the isolated region.

2. The segmented electrostatic actuator of claim 1, wherein the strengthening rib serves as a landing post to reduce contact between membrane segments and corresponding electrodes by limiting travel of the membrane upon contact with the isolated region.

3. The segmented electrostatic actuator of claim 1, wherein the membrane has an increased thickness at segment boundaries to reduce interdependence among neighboring segments.

4. The segmented electrostatic actuator of claim 1, wherein the strengthening rib is configured to stiffen the membrane at the boundary and reduce interdependence among neighboring segments.

5. The segmented electrostatic actuator of claim 1, further comprising control electronics that control actuation of the electrodes so that multiple electrodes are actuated at different times to define a resultant pressure pulse of the actuator.

6. The segmented electrostatic actuator of claim 5, wherein the control electronics operate using a voltage control mode.

7. The segmented electrostatic actuator of claim 5, wherein the control electronics operate using a charge control mode.

8. The segmented electrostatic actuator of claim 1, further comprising control electronics that control actuation of the electrodes so that spatially separated electrodes are actuated to define a resultant pressure pulse of the actuator.

9. The segmented electrostatic actuator of claim 8, wherein the control electronics operate using a voltage control mode.

10. The segmented electrostatic actuator of claim 8, wherein the control electronics operate using a charge control mode.

11. The segmented electrostatic actuator of claim 1, wherein the electrodes are arranged in a one-dimensional shape.

12. The segmented electrostatic actuator of claim 1, wherein the electrodes are arranged in a two-dimensional shape.

13. The segmented electrostatic actuator of claim 1, wherein the fluid ejector is integrated with on-chip addressing electronics.

14. The segmented electrostatic actuator of claim 1, wherein the actuator is provided with a closed-loop control system.

15. The segmented electrostatic actuator of claim 1, wherein the membrane is corrugated.

16. A segmented fluid drop ejector, comprising:

a base substrate;

a segmented flexible membrane provided on top of the substrate;

at least one strengthening rib incorporated into the flexible membrane and provided at segment boundaries;

individually addressable electrodes, one for each membrane segment, provided beneath a corresponding one of the membrane segments and separated from adjacent ones by an isolated region;

a plurality of actuator chambers defined between each of the electrodes and the corresponding membrane segment; and a nozzle plate surrounding the membrane, the nozzle plate defining a fluid pressure chamber between the nozzle plate and the membrane where fluid is stored, the nozzle plate having a nozzle from which fluid is ejected, wherein the individually addressable electrodes are selectively actuated to receive a bias voltage that generates an electrostatic field between any biased electrode and the corresponding membrane segment to attract the corresponding membrane segment toward the respective electrode, the corresponding membrane segment being restored to a previous position upon elimination of the bias voltage so that the at least one strengthening rib is separated by a predetermined distance from the isolated region.

17. The segmented fluid drop ejector of claim 16, wherein a variable drop is ejected by changing the number of segments actuated.

18. The segmented fluid drop ejector of claim 16, wherein the control electronics control actuation of the electrodes so that multiple electrodes are actuated at different times to define a resultant pressure pulse of the actuator.

19. The segmented fluid drop ejector of claim 18, wherein the control electronics operate using a voltage control mode.

20. The segmented fluid drop ejector of claim 18, wherein the control electronics operate using a charge control mode.

21. The segmented fluid drop ejector of claim 16, wherein the control electronics control actuation of the electrodes so that spatially separated electrodes are actuated to define a resultant pressure pulse of the actuator.

22. The segmented fluid drop ejector of claim 21, wherein the control electronics operate using a voltage control mode.

23. The segmented fluid drop ejector of claim 21, wherein the control electronics operate using a charge control mode.

24. The segmented fluid drop ejector of claim 16, wherein the fluid ejector is integrated with on-chip addressing electronics.

25. The segmented fluid drop ejector of claim 16, wherein the fluid ejector is provided with a closed-loop control system.

26. A printer containing at least one fluid drop ejector according to claim 16.

27. The printer of claim 26, wherein the printer is an ink jet printer.

* * * * *